United States Patent [19]

Pelz et al.

[11] 4,251,077

[45] Feb. 17, 1981

[54] TARGET ALIGNMENT SYSTEM FOR USE WITH A GOLF CLUB

[75] Inventors: David T. Pelz, Beltsville; Frederick G. Huegel, Crofton, both of Md.

[73] Assignee: Preceptor Golf Ltd., Laurel, Md.

[21] Appl. No.: 20,511

[22] Filed: Mar. 14, 1979

[51] Int. Cl.[3] ..... A63B 69/36

[52] U.S. Cl. ..... 273/186 A; 273/194 A

[58] Field of Search ..... 273/186 R, 186 A, 186 RA, 273/186 C, 192; 35/29 A

[56] References Cited

U.S. PATENT DOCUMENTS

| | | | |
|---|---|---|---|
| 3,194,563 | 7/1965 | Mackniesh | 273/186 A |
| 4,155,555 | 5/1979 | Fink | 273/186 RA |

*Primary Examiner*—George J. Marlo

*Attorney, Agent, or Firm*—Nicholas J. Aquilino

[57] ABSTRACT

A target alignment system for use with a golf club for determining the precise clubface angle relative to a target path in the direction which a ball is intended to travel. The system provides an indication of the clubface angle during address of the club behind the ball and an indication of the clubface angle at the moment of impact when the ball is struck. The system includes a light source and optics for projecting a light beam, a reflecting surface of the golf club for reflecting the light beam to an array of photodetectors, and a display which is energized in accordance with the measured clubface angle.

12 Claims, 10 Drawing Figures

TARGET ALIGNMENT SYSTEM FOR USE WITH A GOLF CLUB

BACKGROUND OF THE INVENTION

The present invention relates to a target alignment system for use with golf clubs.

In playing the game of golf, it is desirable that the clubface of the golf club which strikes the ball be aligned perpendicular to the intended target path in the direction the ball is to travel as it is struck in order that the ball will be consistently projected to the desired target. Ideally, a golf club would be aligned at address in the proper position and returned to the same position to strike the ball as it is swung. When a golf clubface is misaligned in the address position, the swing then requires a correction factor to return the clubface back to the ideal perpendicular position as the ball is struck. This correction factor makes an already complex precision movement more difficult and introduces additional areas where errors may occur. If the clubface is properly aligned at the address position and not returned to the same position during the course of the swing, then the path the ball travels as it is struck will usually be at variance from the desired ball path. Normally, it is difficult to determine minor variations in the position of the clubhead both at the address position and as the ball is struck because the clubface is at a considerable distance from the eye, usually between from 5 and 6 feet. This causes clubface positions which are out of alignment with the desired path which, if not corrected, could cause the ball to travel on a path which is at variance with the intended target.

When practicing, a player normally has to rely on his own judgment to determine if the clubface alignment factors described above are correct. Because the game of golf generally requires a repeating swing, errors in alignment and swing tend to feel and look natural after repeated use, and it is difficult, if not impossible, for a player to make his own corrections. Whereas this is true for every type of shot used in playing golf, it is particularly critical in putting where a misalignment of the golf clubhead at impact invariably causes the ball to miss the hole thereby adding an additional stroke to the player's score.

A number of prior art practice devices have been made which attempt to teach a golfer the correct swing and how to develop it. A large group of these are mechanical in nature and must be used adjacent to or in combination with a golf club. These distract a golfer from the execution of a normal stroke and/or provide an environment foreign to actual playing condition. Patented examples of this type of mechanical device used for putting are shown in the patents to Rodman U.S. Pat. Nos. 3,899,180, Donaldson 3,471,155, Berkey 4,082,287 and Kenney 4,129,301.

In addition to the mechanical-type devices of which the above are merely a small representative sample, electrical or electronic devices to aid a player in practicing and developing a proper golf stroke are well known in the art. Most of these are rather complex in nature and require specific installations and environments in order to operate properly. Of these types which use sensors to detect the presence or position of a golf clubhead or struck ball, it is a requirement that the clubhead be placed in a specific position relative to the sensing device in order that some type of interrupt pattern representative of the position of the clubhead be recognized and indicated. Here, also, as with the mechanical devices, the equipment used creates an unnatural environment for the player in the practice mode as compared to the normal playing conditions encountered on a golf course while the playing the game of golf.

Particular reference is made to the patents to Walker U.S. Pat. Nos. 2,571,974, Alvarez 2,825,569, McNeill 3,020,049, Wright 3,601,408, Galasson et al 3,892,414, Goldstein 3,894,739, Morris 3,895,366, and Campbell 3,992,012. A number of these patents operate with light sources and photodetectors wherein the clubhead path or ball interrupts a light source to provide an indication that a ball or clubhead has passed.

SUMMARY OF THE INVENTION

The present invention relates to a target alignment system for a golf club which provides a visual readout of the position of the golf club at address and at impact. The system is equally adaptable for use with any golf club having a reflecting surface perpendicular to the clubface; however, it is particularly adaptable for use with a putter to determine the clubface position at address and impact.

The alignment system provides a precise indication of the position of the clubface at address using a real time visual display readout which is continuously updated with each movement of the clubhead. Once a stroke is begun and the golf club is moved away from the address position, the address display is de-energized. When the clubhead is returned to the impact position, the display is re-energized in accordance with the clubhead position at impact. The impact position display remains visible until the system is reset. The system includes a light source which projects a beam of light onto the reflecting surface of the golf clubhead. It is reflected back to a series of photodetectors, the particular ones of which are energized in accordance with the direction of the reflected beam which, in turn, is determined by the clubface alignment angle. Suitable processing circuitry connects the photodetectors with the display. The display array is arranged so that a center position represents the position of the clubface perpendicular to the desired ball path and display lamps on either side of this ideal represent progressively larger deviations from the ideal position.

Thus, the target alignment system of the present invention provides an indication of the face angle of a golf club both at address and at impact. This enables a player by practice to determine the feel and visual appearance of the proper position both at address and impact and also enables the player to determine the necessary corrections as the stroke is being made to bring the display to the ideal position.

Among the objects of the present invention are the provision of a target alignment system for a golf club to provide a precise indication of the clubface position at address and at impact which was heretofore impossible or impractical to determine by a player in a normal practice position; and, the provision of a system to determine and develop through repeated use what the proper address and impact alignment positions are and to make the necessary stroke movements to maintain the clubface in these alignment positions.

DESCRIPTION OF THE PREFERRED EMBODIMENTS

Figure 1:
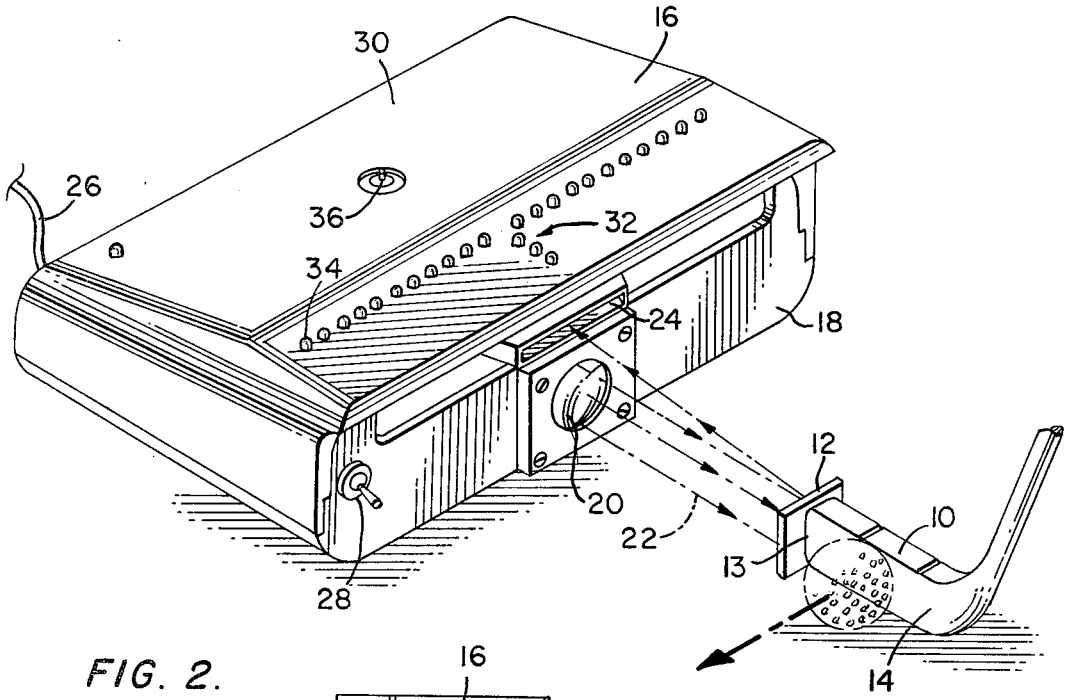
FIG. 1 illustrates a perspective view of the target alignment system of the present invention.

FIG. 1 illustrates a perspective view showing the target alignment system of the present invention used with a putter 10. The putter is of a conventional type and includes a reflecting surface 12 which may be a lightweight mirror attached to a flat surface 13 on the toe of the putter 10 which is perpendicular to both the clubface 14 and the putting surface. The remaining components of the system are provided in a suitable housing 16. The front panel 18 of the housing 16 includes a lens 20 which projects a mirror beam of light 22 which is reflected off of the mirror surface 12 and returned back into an opening 24 in the housing 16 where it is received by suitable photodetectors, as described hereinbelow.

The system may be battery operated or may be connected to a suitable 110-volt supply source by means of a cord 26. A switch 28 mounted on the front panel 18 of the housing 16 is provided to switch the system between the AC and DC mode of operation. The top surface 30 of the housing 16 is provided with an array 32 of display lamps which are color coded to provide an indication of variances of the clubface 14 from an ideal position. The lamps in the center of the display array 32 are set apart from the other lamps and represent the position when the clubface 14 is aligned perpendicular to the intended path. Several display lamps on either side of the center lamps are colored green which indicate a perfect and near-perfect clubface alignment position. The next several lamps on either side of the center are color coded yellow indicating an intermediate range of clubface 14 alignment positions at variance from the ideal. The outermost display lamps are colored red which indicate a substantial variation from the ideal.

The system is provided with an off-scale indicator formed of a single lamp 34 set at an extreme end of the main lamp display array 32. The electronic circuits used in the system provide an automatic shut off after a preset period of time has elapsed and a reset switch 36 mounted on the top surface 30 of the housing 16 is provided to turn the system back on.

Figure 2:
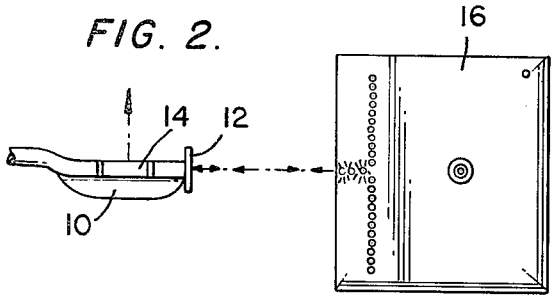
FIG. 2 discloses the system in a first mode of operation.
Figure 3:
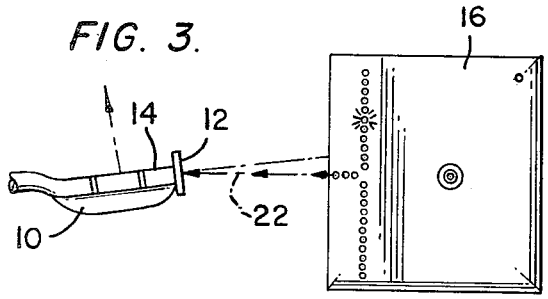
FIG. 3 discloses the system in a second mode of operation.
Figure 4:
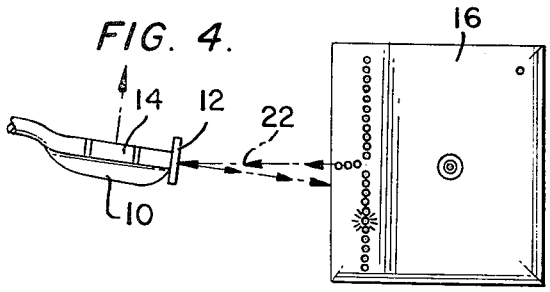
FIG. 4 discloses the system in a third mode of operation.

FIGS. 2, 3 and 4 illustrate various positions a clubhead 10 may take and the display associated therewith. FIG. 2 shows the clubhead 10 having its clubface 14 precisely aligned to the direction the ball is intended to travel. The reflecting mirror 12 is perpendicular to the clubface 14 and to the beam of light being projected from within the housing 16. Therefore, with the clubface in the proper position, the light path 22 is reflected directly back upon itself and the lamps in the center of the display array 32 are energized. FIG. 3 illustrates the club 10 positioned so that the clubface 14 is closed or is to the left of the direction the ball is intended to travel. Thus, the reflecting mirror 12 is displaced from a perpendicular position relative to the light beam 22 and reflects the beam back at an angle causing a display lamp positioned away from the center of the array to be energized. FIG. 4 shows a clubhead 10 positioned so that the clubface 14 is open or to the right with respect to the direction the ball is intended to travel. This causes the reflecting mirror 12 to be displaced from a perpendicular position with respect to the light beam 22 and it is reflected back at an angle to energize a display lamp displaced from the center of the array.

Figure 5:
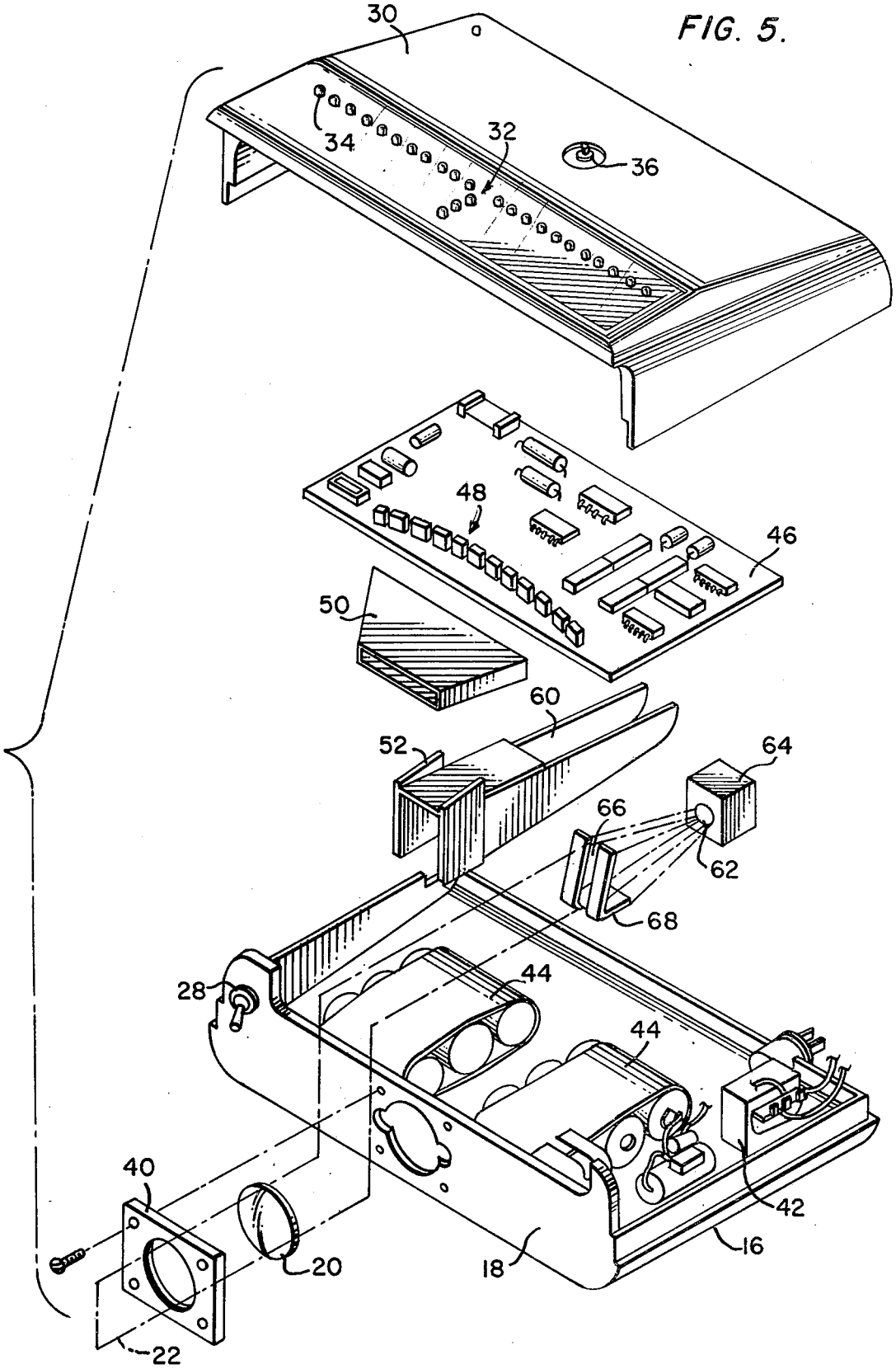
FIG. 5 is an exploded view of a portion of FIG. 1.

FIG. 5 shows an exploded view of the light and display apparatus of the present invention. As described with respect to FIG. 1, a housing 16 includes a front panel 18 and top surface 30. An array of display lamps 32 is provided on the top surface 30 of the housing 16 along with an off-scale indicator lamp 34 and a reset switch 36. The panel 18 of the housing 16 includes a lens holder 40 which is suitably attached to the panel 18 by screws or the like in order to hold the lens 20 in place. The AC/DC mode switch 28 is also secured to the front panel 18 of the housing 16. Mounted within the housing 16 is a suitable AC transformer 42 and a series of batteries 44 which are used when the system is in the DC mode. The electronic components of the system are mounted on a printed circuit board 46 which includes an array of photodetectors 48 suitably positioned behind a fan-shaped shroud 50 the front of which forms the opening 24 on the front of the housing 16. The shroud 50 is positioned on a mounting bracket 52 formed of two inclined surfaces which precisely position the opening 24 in order that reflected light from the mirror on the clubhead may be picked up by the photodetector array 48. A channel 60, mounted in the lower portion of the housing 16 forms a path for the system optics. A suitable light source 62, mounted within a holder 64, and a slit 66, formed in an L-shaped member 68, are positioned within the channel 60. When the device is assembled, the front of the channel 60 is adjacent the lens and the beam of light 22 from the source 62 is projected through the slit 66 onto the lens and it emerges from the housing 16 as a narrow vertically disposed beam of light 22. It will be appreciated that other light sources, such as a laser, may be used. Also, the narrow beam may be formed optically rather than through a slit.

Figure 8A:
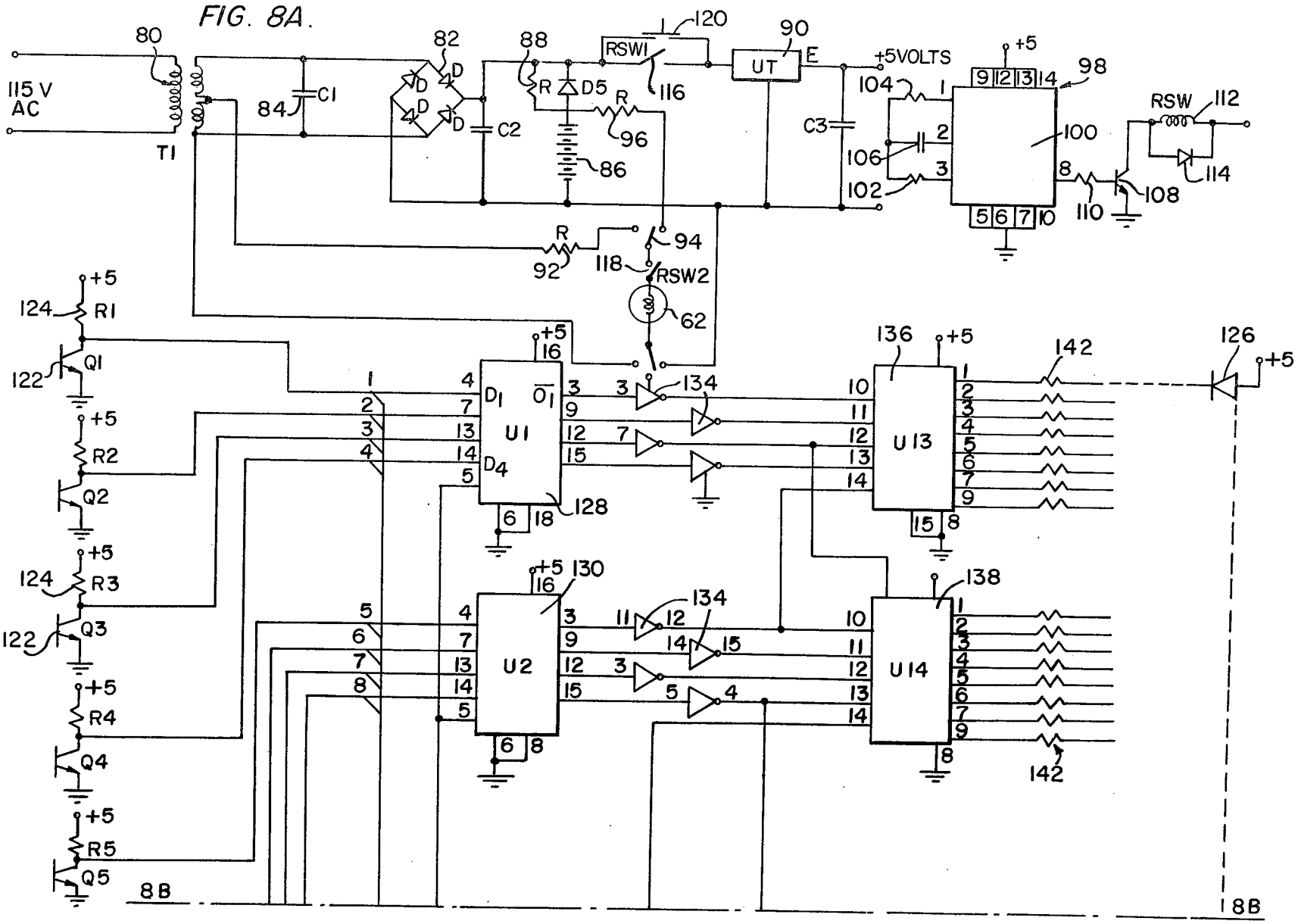
FIGS. 8*a* and 8*b* show the circuit of the present invention.
Figures 8B, 9:
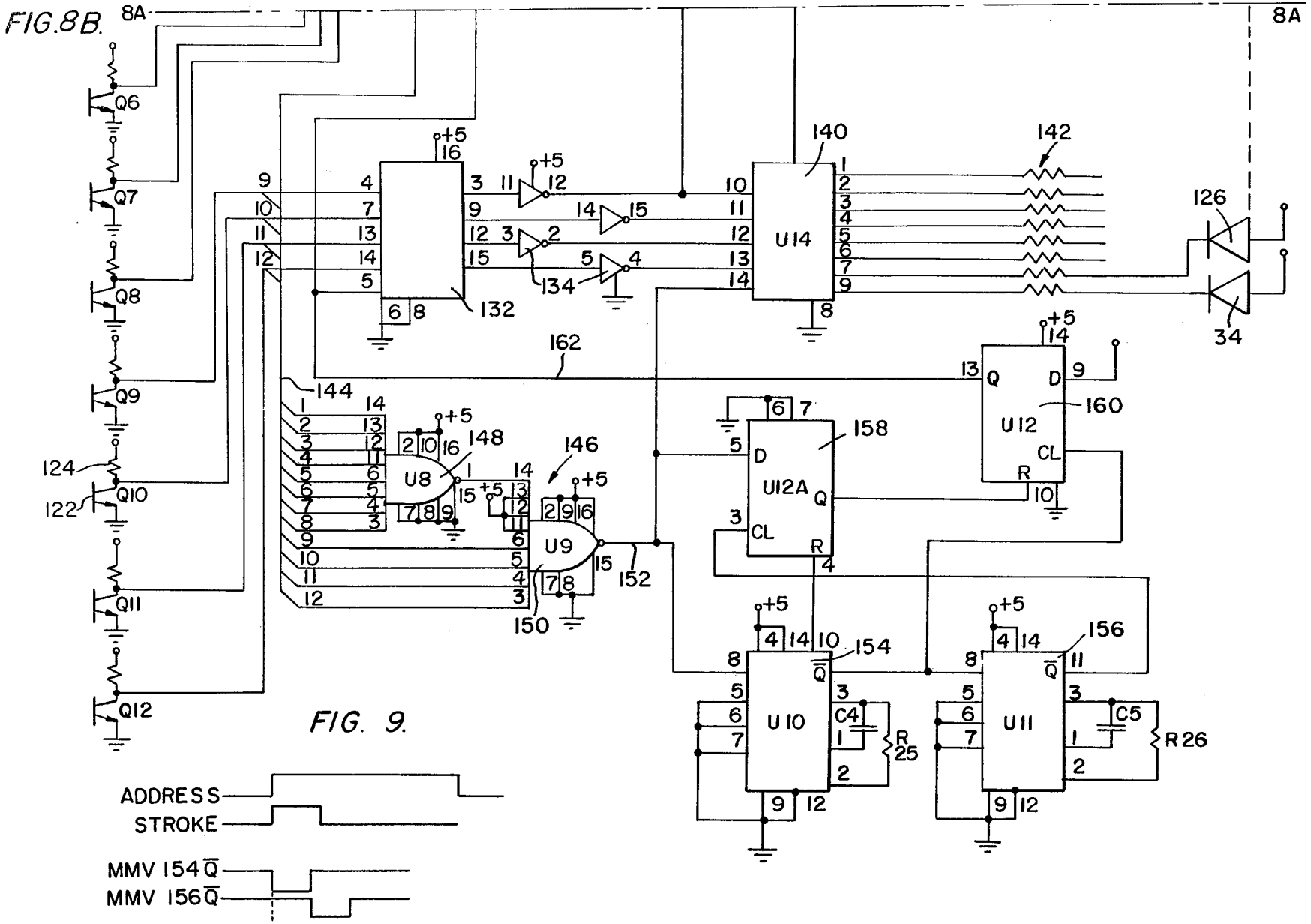
FIG. 9 shows waveforms of the circuit of FIGS. 8*a* and 8*b*.

The system electronic circuit is illustrated in FIGS. 8A and 8B and its operation is further explained with reference to the waveforms shown in FIG. 9. The system is connected to a 115 v. AC source of supply through a transformer 80, the output of which is connected to a diode bridge 82. A transient suppressor capacitor 84 is connected across the input to the bridge. The output of the bridge supplies a DC voltage of approximately 12 v. across a battery 86 through a limiting resistor 88 and to a voltage regulator 90, the output of which provides a 5 v. DC source of supply to the circuit. The output of the AC transformer 80 is center tapped to provide a 5 v. source of supply through a resistor 92 to the light source 62. The light source 62 is connected using a double pole, double throw switch 94 to either the battery 86 through a current limiting resistor 96 or to the AC source of supply at the center tap of the transformer 80.

The system includes a timing circuit 98 which is designed to turn off the system after approximately 10 minutes of operation. The timing circuit 98 operates both in the AC and DC modes to turn the system off and to prevent its being inadvertently left unattended and draining the power sources needlessly. The timer includes an integrated circuit 100, timing resistors 102 and 104 and capacitor 106. The output of the integrated circuit 100 is fed to an NPN transistor 108 through a current limiting resistor 110 to a relay coil 112. A transient suppression diode 114 is provided across the relay coil 112. The relay coil 112 includes relay contacts 116 and 118 in the power supply circuit. Contact 116 is in series with the voltage regulator 90 which supplies the power input to the system. The second relay contact switch 118 is in series with the light source 62. The integrated circuit 10 cuts off after ten minutes of operation which in turn de-energizes the relay 112. The relay contacts 116 and 118 open to disengage the voltage regulator 90 and the lamp 62 from the power supply. An on/off switch 120 is connected across the relay contact switch 116 and is used to manually energize the system.

A series of twelve photodetectors 122 each one of which is connected to the 5 v. source of supply through a resistor 124 at its collector. The emitter is grounded. The twelve photodetectors 122 control twenty-three display lamps 126 in a manner described hereinbelow. The outputs of the photodetectors 122 provide current to a series of integrated circuit latches 128, 130 and 132. The output of these integrated circuits are fed through buffer amplifiers 134 which increase the current to a second series of integrated circuit programmable, read-only memories 136, 138, 140. The output of these memories are coupled to the LED display lamps 126 through current limiting resistors 142. The memories 136, 138 and 140 are provided with a number of output lines, corresponding to each of the LED display lamp 126. The particular output line of the memories 136, 138 and 140 which is energized depends upon which photodetector 122 or pair of photodetectors are energized at the particular time a readout is being performed. The output of programmable memory 138 also feeds the off-scale display lamp 34 when the light beam 22 does not hit any of the photodetectors 122.

Another output line 144 from the photodetectors 122 is connected to a cascaded gating system 146 including an OR gate 148 and NOR gate 150. When any one of the photodetector output lines are energized, the NOR gate 150 produces an output signal to line 152 which is connected to the programmable memory 140. A signal on line 152 produces an output from the programmable memory 140 to de-energize the off-scale indicator lamp 34. The output from the NOR gate 150 is also supplied to a circuit consisting of one-shot monostable multivibrators 154 and 156 and flip-flops 158 and 160. The output of this circuit is fed back to the latch circuits 128, 130 and 132 by way of a latch control line 162 to provide a latching signal to switch the latches into the latch mode. When the latches are in the latch mode, the particular display lamp that is energized remains energized independent of the input conditions to the photodetectors.

The latch circuits 128, 130 and 132 are designed so that when a latch signal is present, the particular output from the latch circuit which is energized is maintained. When no latch signal is present to the latch circuits, signals from the photodetectors 122 are free to pass through to the display circuits. In the address position, at least one of the photodetectors 122 is energized and produces a signal on the line 152. This signal has a relatively long duration as seen with reference to the timing chart of FIG. 9. As further seen from the timing chart, if the address signal is maintained on the line 152, the monostable, multivibrators 154 and 156 and the corresponding flip-flops 158 and 160 complete their cycle, thereby setting the latch control line low, as described hereinbelow, which in turn unlatches the latch circuits 128, 130 and 132 allowing whatever inputs are present to the latch circuits to pass through to the display lamps 126. When the output signals from the photodetectors 122 is of a shorter duration, such as occurs during a stroke, the flip-flop 158 and 160 remain in the high state and the latching signal is present on line 162 to the latch circuits 128, 130 and 132 thereby maintaining the particular display lamp 126 energized corresponding to the photodetector 122 which was illuminated during the swing.

The operation of the circuits is described in more detail as follows. The signal from NOR gate 150 clocks the $\overline{Q}$ output of the multivibrator 154 into its low state as seen in FIG. 9. This signal is fed to the clock input of flip-flop 160 and after a predetermined amount of time determined by the parameters of the multivibrator 154, the $\overline{Q}$ output transitions back to its high state and clocks the flip-flop 160 providing a latching signal on the line 162. The $\overline{Q}$ output low-to-high transition also clocks one-shot multivibrator 156 producing a $\overline{Q}$ output having a low state which is connected to the clock input of flip-flop 158 as also seen in FIG. 9. When the $\overline{Q}$ output of multivibrator 156 transitions back to its high state, flip-flop 136 is clocked providing a high output assuming line 152 is in the high state. This high level then resets flip-flop 160 which, in turn, de-energizes the latch signal on line 162.

If none of the photodetectors are energized, the output from the NOR gate 150 on line 152 is low and, therefore, when the high-to-low transition of the $\overline{Q}$ output of multivibrator 156 occurs, the $\overline{Q}$ output of flip-flop 158 remains in the low state and does not reset the flip-flop 160 thereby enabling the latch signal to remain on line 162.

In terms of a swing, in the address position, one of the photodetectors 122 is always energized assuming that the reflector 12 and light beam 22 are on scale. This produces an output signal on line 152 for a period of time longer than the parameters of the multivibrator and flip-flop circuits so that the latching signal is removed from the line 162. In the switch condition, the signal remains on the line 152 for a relatively short duration of time which is less than the parameters of the multivibrator circuits, as seen in FIG. 9, so that the latch signal remains on the line 162. In this way, a display lamp 126 representing the position of the clubface 14 of the club 10 during an actual stroke, as opposed to the position during address, remains energized until the system is reset.

Figure 6:
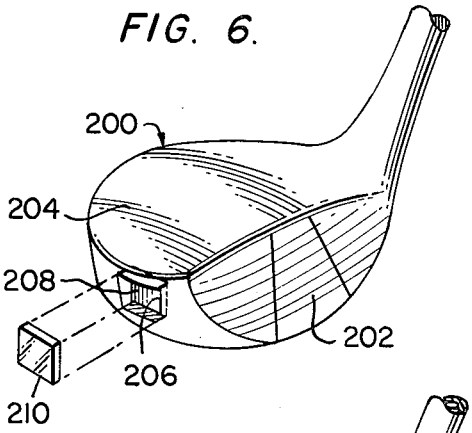
FIG. 6 shows one embodiment of a golf club suitable for use with the present invention.

FIG. 6 illustrates a wood-type golf clubhead 200 having a ball striking face 202. The toe 204 of the clubhead 200 includes a recess 206 having a flat surface 208 into which is mounted a reflecting mirror 210. The orientation of the flat surface 208 is such that it is perpendicular to the clubface 202 and to the ground plane when the clubhead 200 is properly soled.

Figure 7:
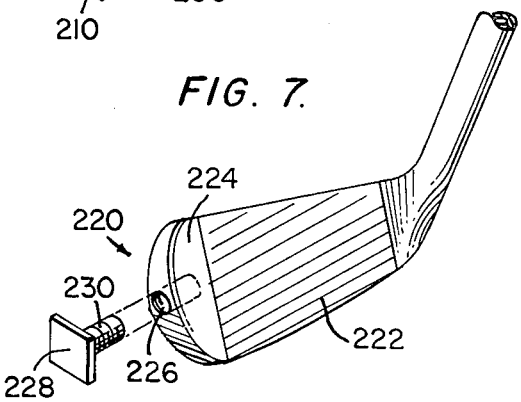
FIG. 7 shows a second embodiment of a golf club suitable for use with the present invention.

FIG. 7 shows an iron type club 220 having a ball striking face 222. The toe 224 of the club 220 includes a threaded hole 226 which is adapted to mount a reflecting mirror 228 having a threaded shaft 230. The orientation of the hole 226 and shaft 230 is perpendicular to the axis of the clubface 222 of the iron 220 and the ground plane when the club is properly soled.

Thus, the wood clubhead 200 and iron clubhead 220 are suitable for use with the system of the present invention.

It will be appreciated many modifications may be made in the present invention in keeping within the scope of the following claims.

What is claimed is:

1. A method for determining the precise club face angle of a golf club with respect to a given target direction during the address position prior to the initiation of a stroke, and the club face angle at the moment of impact comprising the steps ofproviding a reflecting surface on the golf club at a known angle relative to the ball striking face of the club;

projecting a beam of radiation at a known angle with respect to the target direction toward said reflecting surface;

making a first reflection of said radiation beam from said reflecting surface prior to the initiation of a stroke movement by said golf club;

detecting said reflected radiation beam and providing a first indication representative of the club face angle during the address position of said golf club;

initiating a stroke movement of said golf club;

making a second reflection from said reflecting surface on the golf club after initiation of a stroke movement while the club is moving during the stroke and providing a second indication representative of the club face angle during the stroke movement.

2. The method of claim 1 wherein said first reflection is made with the golf club in a rest position.

3. The method of claim 1 wherein said second reflection is made at the same time the club head impacts against a ball.

4. The method of claim 1 wherein said first and second indications are provided by display lamps.

5. The method of claim 1 wherein said beam of radiation is formed by a light source.

6. The method of claim 1 wherein said first indication is changeable in accordance with movement of said golf club prior to the initiation of a stroke movement.

7. The method of claim 1 wherein said second indication representing the position of said club face at impact is maintained until a reset function is performed.

8. A golf club alignment system providing an indication of the angle of the ball striking face of a golf club with respect to a given target direction in an address position with the club head at rest and in a stroke position with the club head moving comprising the combination of:

a radiation source;

means for projecting said radiation source in a beam;

reflecting means attached to said gold club adapted to reflect said radiation beam at an angle determined by the position of said ball striking face;

a series of detectors operably responsive to said reflected radiation beam;

indicator means including a plurality of indicators, particular ones of said indicators connected to particular ones of said series of detectors;

circuit means for energizing one of said indicators in accordance with the corresponding detector being radiated by said radiation beam; and further circuit means including a timer circuit for maintaining a particular one of said indicators energized when said corresponding detector is radiated for a period of time less than the predetermined time parameters established by said timer circuit.

9. The system of claim 8 wherein said indicator means comprises an array of lights, the center portion of said array corresponding to a club face positioned perpendicular to the given target direction, and side portions of said array of lights on either side of said center position corresponding to club face angles deviating from said perpendicular position, said center position being weighted to provide a more dominant, visual display than the side portions of said array.

10. The system of claim 9 wherein the center position of said light array includes a plurality of lights and wherein the side positions on either side of said center position include a single display light at each position.

11. The system of claim 8 wherein said radiation source is a light beam.

12. The system of claim 8 further including circuit means for resetting said timing circuit.

* * * * *